United States Patent [19]

Snider

[11] Patent Number: 4,502,731

[45] Date of Patent: Mar. 5, 1985

[54] SEAT FRAME

[76] Inventor: Robert A. Snider, 9832 N. Range Line Rd., Mequon, Wis. 53092

[21] Appl. No.: 623,974

[22] Filed: Jun. 25, 1984

Related U.S. Application Data

[63] Continuation of Ser. No. 269,123, Jun. 1, 1981.

[51] Int. Cl.[3] ..... A47C 7/02

[52] U.S. Cl. ..... 297/452; 297/DIG. 2; 297/459

[58] Field of Search ..... 297/452, 458, 459, DIG. 1, 297/DIG. 2, 455; 5/247; 267/80

*Primary Examiner*—Francis K. Zugel

*Attorney, Agent, or Firm*—Benjamin P. Reese, II

[57] ABSTRACT

A one-piece seat frame structure having a plurality of parallel curvilinear slots which demarcate cantilever-action spring segments. A thin-walled, hollow, molded plastic body, or a similar body of another suitable relatively rigid material having resilient characteristics, has a pair of side walls, a rear wall, a front wall and a positively bowed top. A plurality of parallel curvilinear slots are provided through the top to demarcate a plurality of parallel curvilinear spring segments. In response to a typical load created by a seat occupant, the spring segments are deflected downward in a cantilever manner.

4 Claims, 7 Drawing Figures

SEAT FRAME

This application is a continuation of application Ser. No. 269,123, filed June 1, 1981.

BACKGROUND OF THE INVENTION

This invention relates to a one-piece seat frame structure having a plurality of parallel curvilinear slots which demarcate cantilever-action spring segments.

Seat back assemblies, seat bottom assemblies, and combination seat back-seat bottom assemblies which consist essentially of a seat frame having a plurality of springs, a cushion or pad which rests on the springs, and an upholstery cover are well known in the seating and related arts. Such assemblies are widely used as components of seats for auditoria, theaters, schools and similar public buildings and as components of seats for buses, trains, airplanes and other public transportation vehicles. Of course, such assemblies are used as components of seats for many other public and private use environments.

For the majority of the seat assemblies of the type described above, an open seat frame is manufactured from a suitable structural material, often a wood framing or steel sheet material, and conventional steel springs are positioned across one opening of the frame to support the weight of the occupant of the seat. Typically, the steel springs are of the coiled or serpentine type and are positioned parallel to each other with the opposite ends of each secured to the frame by conventional means, such as engaging holes in the frame with hooks formed on the ends of the springs. Other types of steel springs, such as either bowed or flat slats, and spring fabricated from other materials, such as wood or plastic, are occasionally used with such assemblies.

It is well known to those skilled in the seating and related arts that seat assemblies having a conventional open seat frame with a plurality of conventional springs secured thereto have many inherent disadvantages. For example, conventional steel springs having suitable elastic characteristics add substantially to the cost of manufacturing such assemblies. Furthermore, periodic adjustment and repair is required to maintain the effectiveness of conventional steel springs as flexible or resilient support means. A thick cushion or pad is required to distribute and transfer the seat occupant's weight to the springs and to protect the seat occupant from possible bodily injury by contact with the springs. Upholstering is often a problem when a conventional open seat frame having a plurality of conventional springs is utilized since the springs can tear both the cushion or pad material and the upholstery material.

Various structures have been proposed, and occasionally used, as alternatives for conventional open seat frames having a plurality of conventional springs. For example, U.S. Pat. No. 3,399,883, issued to McKey, for a "Seat Construction", discloses a seat frame structure consisting essentially of a single sheet of resilient material which functions as a flexible or resilient support means for a seat assembly. Two rows of parallel tapered slots permit the midportion of the sheet to assume the contour of the load created by the seat occupant. A similar seat frame structure is disclosed in U.S. Pat. No. 2,804,129, issued to Propst, wherein a single seat of resilient material is provided with parallel untaped slots around its periphery. Each end of each such slot terminates in a circular recess. Unfortunately, neither these structures, nor similar structures which are known in the seating and related arts, have proved to be entirely satisfactory as flexible or resilient support means for seat assemblies inasmuch as they do not efficiently assume the contour of the load created by the seat occupant.

It is desirable to have a one-piece seat frame structure which efficiently assumes the contour of the load created by the seat occupant. Such a seat frame structure, when used as a component of a seat assembly, should be as comfortable for the seat occupant as a conventional open seat frame having a plurality of conventional springs. But, such a seat frame structure should not have the manufacturing cost and other disadvantages which are inherent in conventional structures.

SUMMARY OF THE INVENTION

The present invention provides a one-piece seat frame structure which overcomes many of the inherent disadvantages of conventional seat frames having a plurality of conventional springs. The seat frame structure of the present invention is relatively inexpensive to manufacture. Yet, since it efficiently assumes the contour of the load created by the seat occupant, a seat assembly using the seat frame structure of the present invention as a component is as comfortable for the occupant as a conventional seat assembly.

The seat frame structure of the present invention comprises an essentially rectangular, hollow body having an open bottom and a positively bowed top. A plurality of parallel curvilinear slots are provided through its top to demarcate a plurality of parallel curvilinear spring segments. In response to a typical load created by a seat occupant, the spring segments are deflected downward in a cantilever manner. The radius of curvature of the slots and the distance between adjacent slots can be varied to control the configuration of the spring segments, and, thereby, to control the degree of firmness of a seat assembly incorporating the seat frame structure of the present invention.

DETAILED DESCRIPTION OF THE PREFERRED EMBODIMENT

The preferred embodiment of the seat frame structure of the present invention is illustrated in FIGS. 1–7. In its preferred embodiment, the seat frame structure of the present invention is used as a component of a seat bottom assembly. However, seat frame structures embodying concepts of the present invention can be fabricated for use as components of seat back assemblies and combination seat back-seat bottom assemblies.

Figure 1:
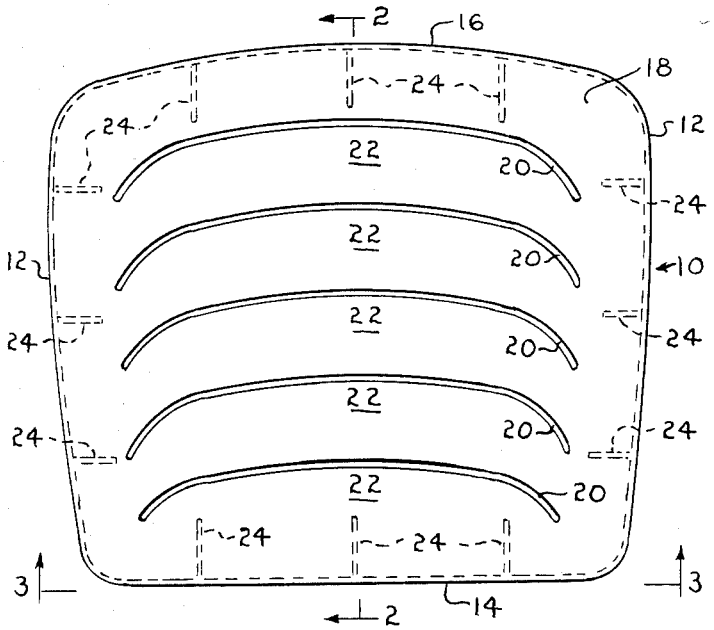
FIG. 1 is a top plan view of a seat frame structure embodying concepts of the present invention.
Figure 2:
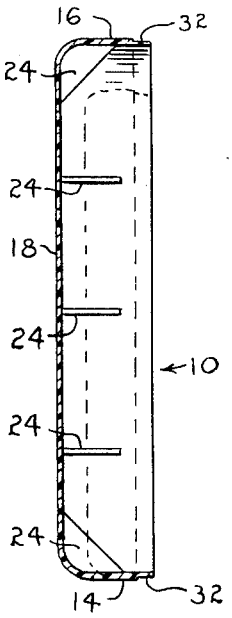
FIG. 2 is an elevational view, in section, taken along line 2—2 in FIG. 1.
Figure 3:
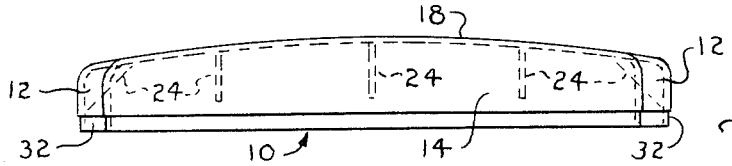
FIG. 3 is an elevational view taken along line 3—3 in FIG. 1.

Referring to FIGS. 1–3, the seat frame structure which is illustrated comprises a thin-walled, hollow, molded plastic body 10 having a pair of essentially parallel side walls 12, a straight rear wall 14 and an outwardly curved front wall 16, both perpendicular to said side-walls 12, and a top 18. A plurality of parallel curvilinear slots 20 through the top 18 demarcate a plurality of parallel curvilinear spring segments 22. The top 18 has a gentle upward slope from the side walls 12 which creates a slight positive bow for the spring segments 22. A plurality of short gussets or ribs 24 are positioned in the interior void of the plastic body 10 to reinforce the structure at the intersections of the side walls 12, the rear wall 14 and the front wall 16 with the top 18.

Figure 4:
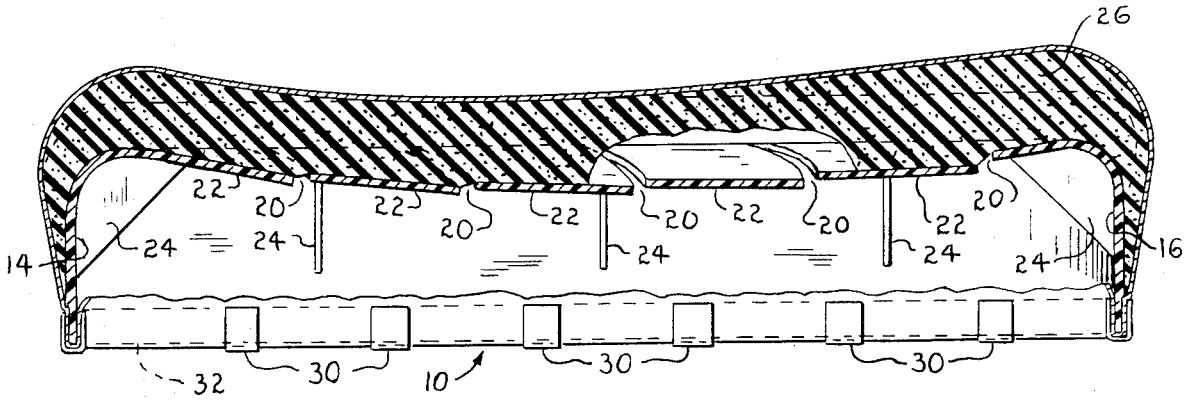
FIG. 4 is an elevational view, in section, taken along line 4—4 in FIG. 1, but further illustrating a seat cushion and a seat cover fitted over the seat frame structure and the cantilever-action spring segments of the seat frame structure partially deflected in response to a typical load created by a seat occupant.

Referring to FIG. 4, a seat cushion 26 formed from a conventional foam rubber or another suitable resilient material rests on the top 18 of the plastic body 10. Preferably, the seat cushion 26 is pre-molded or formed in place to fit snugly over and around the top 18, the side walls 12, the rear wall 14 and the front wall 16 of the plastic body 10. A seat cover 28 of conventional upholstery material is fitted over the seat cushion 26 and secured to the lower edges of the side walls 12, the rear wall 14 and the front wall 16 with conventional u-clips 30 or other conventional means. Preferably, an indentation 32 is provided around said lower edges to recess the u-clips 30.

Figure 5:
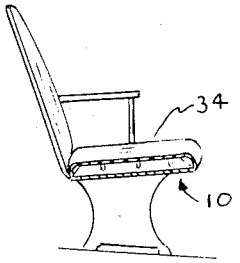
FIG. 5 is a side elevational view, in partial section, of an auditorium or theater seat illustrating one use for the seat frame structure of the present invention.
Figure 6:
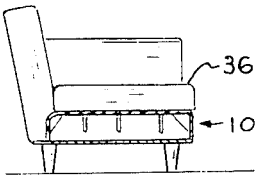
FIG. 6 is a side elevational view, in partial section, of a chair or sofa illustrating another use for the seat frame structure of the present invention.
Figure 7:
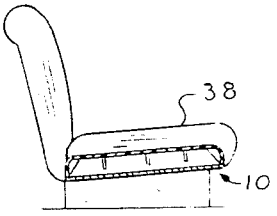
FIG. 7 is a side elevational view, in partial section, of a car or truck seat illustrating still another use for the seat frame structure of the present invention.

Having described the seat frame structure of the present invention, its use environment and performance during use will now be described. In FIGS. 5–7, the seat frame structure of the present invention is shown as a component of a seat bottom assembly for an auditorium or theater seat 34, a chair or sofa 36, and a car or truck seat 38, respectively. Returning to FIG. 4, the response of the seat frame structure of the present invention to a typical load which is created by an occupant of one of the seats in FIGS. 5–7 is clearly illustrated. As with conventional bowed slot springs, each of the spring segments 22 has elastically deformed such that its positive bow has become a negative bow. But, unlike conventional bowed spring slats, the elastic deformation is not uniform along the width of each spring segment 22. Rather, the leading edge of each spring segment 22, i.e. the edge nearest to the front wall 16 of the plastic body 10, is deflected downward in a manner similar to that of a conventional cantilever beam which has a concentrated load applied to its free end.

Strictly speaking, the spring segments 22 do not conform to the classical definition of a cantilever, i.e. a beam or other member securely fixed at one end and hanging free at the other end. But, because of their characteristic response to load described above, it is believed to be not only helpful but also proper to describe the spring segments 22 as cantilever-action spring segments or cantilever-action springs. The use of parallel curvilinear slots 20 to demarcate cantilever-action spring segments 22 in the top 18 of a molded plastic body 10 has proved to be an efficient means for economically constructing a one-piece seat frame structure having suitable resiliency. Furthermore, the use of such slots 20 permits the seat designer to achieve various degrees of resiliency, i.e. a relatively soft seat or a relatively firm seat, by varying the radius of curvature of the slots 20 and the distance between adjacent slots 20, thereby controlling the contour and width of the cantilever-action spring segments 22.

While the preferred embodiment of the present invention has been described as a molded plastic body, it should be understood that the present invention is not limited by the materials or methods for fabrication of the seat frame structure. Any relatively thin material which has suitable resilient characteristics and which can be formed into a relatively rigid body is suitable for fabrication of the seat frame structure of the present invention. In like manner, any fabrication method which is compatible with achieving the desired resiliency and rigidity characteristics for the material selected can be used. Finally, it should be understood that there may be other embodiments which fall within the spirit and scope of the invention as defined by the claims.

What is claimed is as follows:

1. A one-piece seat frame for an upholstered seat, comprising a relatively rigid, resilient, thin-walled hollow, molded plastic body having a pair of parallel side walls, a rear wall perpendicular to said side walls, a front wall perpendicular to said side walls, and a top for support of a one-piece, molded foam rubber or other similar seat cushion which fits over and around said top, said side walls, said rear wall and said front wall, said top having a plurality of parallel curvilinear slots which demarcate a plurality of parallel curvilinear spring segments positioned perpendicular to said side walls, and said top being sloped upward from said side walls to create a positive bow for each of said spring segments such that each of said spring segments deflects downward in a cantilever manner in response to the load created by the occupant of the upholstered seat but returns to its bowed position when the load is removed, said side walls and said rear wall being essentially straight and said front wall being outwardly curved in the shape of said curvilinear slots.

2. A seat frame as recited in claim 1, wherein the lower edges of said side walls, said rear wall and said front wall have a continuous indentation adaptable for receipt of a plurality of u-clips for attaching an upholstery seat cover enclosing said body and said seat cushion.

3. A seat frame as recited in claim 1, further comprising a plurality of interior, reinforcing gussets or ribs positioned perpendicular to said side walls, said rear wall and said front wall.

4. A one-piece seat frame for an upholstered seat, comprising a relatively rigid, resilient, thin-walled, hollow, molded plastic body having a pair of essentially straight, parallel side walls, an essentially straight rear wall perpendicular to said side walls, an outwardly curved front wall essentially perpendicular to said side walls, a plurality of interior, reinforcing gussets or ribs positioned perpendicular to said side walls, said rear wall and said front wall, and a top for support of a one-piece, molded foam rubber or other similar seat cushion which fits over and around said top, said side walls, said rear wall and said front wall, said top having a plurality of parallel curvilinear slots which demarcate a plurality of parallel curvilinear spring segments positioned perpendicular to said side walls and parallel to said front wall, said top being sloped upward from said side walls to create a positive bow for each of said spring segments such that each of said spring segments deflects downward in a cantilever manner in response to the load created by the occupant of the upholstered seat but returns to its bowed position when the load is removed, and said side walls, said rear wall and said front wall having a continuous indentation around their respective lower edges, said indentation being adaptable for receipt of a plurality of u-clips for attaching an upholstery seat cover enclosing said body and said seat cushion.

* * * * *